US008096755B2

(12) United States Patent
Kammel et al.

(10) Patent No.: US 8,096,755 B2
(45) **Date of Patent: *Jan. 17, 2012**

(54) CROWNED RAILS FOR SUPPORTING ARCUATE COMPONENTS

(75) Inventors: Raafat A. Kammel, Peabody, MA (US); Humphrey W. Chow, Brookline, MA (US); Michael Peter Kulyk, Kittery, ME (US)

(73) Assignee: General Electric Company, Schenectady, NY (US)

( * ) Notice: Subject to any disclaimer, the term of this patent is extended or adjusted under 35 U.S.C. 154(b) by 665 days.

This patent is subject to a terminal disclaimer.

(21) Appl. No.: 11/643,098

(22) Filed: Dec. 21, 2006

(65) Prior Publication Data

US 2008/0152485 A1 Jun. 26, 2008

(51) Int. Cl.
*F01D 11/08* (2006.01)

(52) U.S. Cl. ..... 415/173.1; 415/213.1

(58) Field of Classification Search ..... 415/173.1, 415/213.1

See application file for complete search history.

(56) References Cited

U.S. PATENT DOCUMENTS

| | | | | |
|---|---|---|---|---|
| 4,485,620 | A | 12/1984 | Koenig et al. | |
| 4,759,687 | A * | 7/1988 | Miraucourt et al. | 415/127 |
| 5,618,161 | A | 4/1997 | Papageorgiou et al. | |
| 5,848,854 | A | 12/1998 | Brackett | |
| 6,227,798 | B1 | 5/2001 | Demers et al. | |
| 6,361,273 | B1 | 3/2002 | Eng et al. | |
| 6,425,738 | B1 * | 7/2002 | Shaw | 415/208.1 |
| 6,902,371 | B2 | 6/2005 | Anderson, Jr. et al. | |
| 6,932,568 | B2 | 8/2005 | Powis et al. | |
| 6,969,233 | B2 | 11/2005 | Powis et al. | |
| 2005/0276687 | A1 * | 12/2005 | Ford et al. | 415/173.1 |
| 2006/0251519 | A1 | 11/2006 | Benedetti et al. | |
| 2008/0152488 | A1 * | 6/2008 | Kammel et al. | 415/209.4 |

FOREIGN PATENT DOCUMENTS

GB 2327466 A 1/1999

OTHER PUBLICATIONS

European Search Report dated Mar. 25, 2008.
GB 0724094.8, Great Britain Search Report, Mar. 26, 2008.
GB 0724094.8, Great Britain Office Action, Nov. 26, 2010.

* cited by examiner

*Primary Examiner* — Edward Look
*Assistant Examiner* — Aaron R Eastman
(74) *Attorney, Agent, or Firm* — General Electric Company; William Scott Andes

(57) ABSTRACT

A flange for supporting arcuate shrouds and shroud hangers comprising at least one arcuate rail, each arcuate rail having an inner radius, a first taper location, a first taper region, a second taper location, a second taper region, wherein the thickness of at least a portion of the first taper region is tapered and wherein the thickness of at least a portion of the second taper region is tapered.

16 Claims, 11 Drawing Sheets

CROWNED RAILS FOR SUPPORTING ARCUATE COMPONENTS

BACKGROUND OF THE INVENTION

This invention relates generally to improving the durability of gas turbine engine components and, particularly, in reducing the thermal stresses in the turbine engine stator components such as nozzle segments, shroud segments and shroud hangers.

In a typical gas turbine engine, air is compressed in a compressor and mixed with fuel and ignited in a combustor for generating hot combustion gases. The gases flow downstream through a high pressure turbine (HPT) having one or more stages including one or more HPT turbine nozzles, shrouds and rows of HPT rotor blades. The gases then flow to a low pressure turbine (LPT) which typically includes multistages with respective LPT turbine nozzles, shrouds and LPT rotor blades. The HPT and LPT turbine nozzles include a plurality of circumferentially spaced apart stationary nozzle vanes located radially between outer and inner bands. Typically, each nozzle vane is a hollow airfoil through which cooling air is passed through. Cooling air for each vane can be fed through a single spoolie located radially outwardly of the outer band of the nozzle. In some vanes subjected to higher temperatures, such as the HPT vanes for example, an impingement baffle may be inserted in each hollow airfoil to supply cooling air to the airfoil.

The turbine rotor stage includes a plurality of circumferentially spaced apart rotor blades extending radially outwardly from a rotor disk which carries torque developed during operation. Turbine nozzles are located axially forward of a turbine rotor stage. The turbine shrouds are located radially outward from the tips of the turbine rotor blades so as to form a radial clearance between the rotor blades and the shrouds. The shrouds are held in position by shroud hangers which are supported by flange rails engaging with annular casing flanges. The turbine nozzles, shrouds and shroud hangers are typically formed in arcuate segments. Each nozzle segment has two or more hollow vanes joined between an outer band segment and an inner band segment. Each nozzle segment and shroud hanger segment is typically supported at its radially outer end by flanges attached to an annular outer casing. Each vane has a cooled hollow airfoil disposed between radially inner and outer band panels which form the inner and outer bands. In some designs the airfoil, inner and outer band portions, flange portion, and intake duct are cast together such that the vane is a single casting. In some other designs, the vane airfoils are inserted in corresponding openings in the outer band and the inner band and brazed along interfaces to form the nozzle segment.

Certain two-stage turbines have a cantilevered second stage nozzle mounted and cantilevered from the outer band. There is little or no access between first and second stage rotor disks to secure the segment at the inner band. Typical second stage nozzles are configured with multiple airfoil or vane segments. Two vane designs, referred to as doublets, are a very common design. Three vane designs, referred to as Triplets are also used in some gas turbine engines. Doublets and Triplets offer performance advantages in reducing split-line leakage flow between vane segments. However, the longer chord length of the outer band and mounting structure compromises the durability of the multiple vane segment nozzles. The longer chord length causes an increase of chording stresses due to the temperature gradient through the band and increased non-uniformity of airfoil and band stresses, such as for example, shown in FIG. 6 for a conventional outer band.

The increased thermal stress may reduce the durability of an outer band and the turbine vane segment. Similarly, thermal stresses are present in turbine shroud segments and shroud hangers due to thermal gradients that exist in these components. It is desirable to have a flange design for supporting turbine engine components such as the turbine nozzle segments and shroud segments that avoid reduction in the durability of shrouds and multiple vane segments due to longer chord length of the outer band and mounting structure. It is also desirable to have turbine nozzle segments that avoid increase of chording stresses due to temperature gradient through the outer band and increased non-uniformity of airfoil stresses due to longer chord length of the multiple vane segments. It is also desirable to have turbine nozzle segments that avoid increase of stresses near the middle vane of a Triplet or other multiple vane segments which limits the life of the segment. It is also desirable to have turbine shrouds and shroud hangers that avoid increase of chording stresses due to thermal gradients.

BRIEF DESCRIPTION OF THE INVENTION

A flange for supporting arcuate shrouds and shroud hangers comprising at least one arcuate rail, each arcuate rail having an inner radius, a first taper location, a first taper region, a second taper location, a second taper region, wherein the thickness of at least a portion of the first taper region is tapered and wherein the thickness of at least a portion of the second taper region is tapered.

BRIEF DESCRIPTION OF THE DRAWINGS

The subject matter which is regarded as the invention is particularly pointed out and distinctly claimed in the concluding part of the specification. The invention, in accordance with preferred and exemplary embodiments, together with further objects and advantages thereof, is described in the following detailed description taken in conjunction with the accompanying drawings in which:

DETAILED DESCRIPTION OF THE INVENTION

Figure 1:
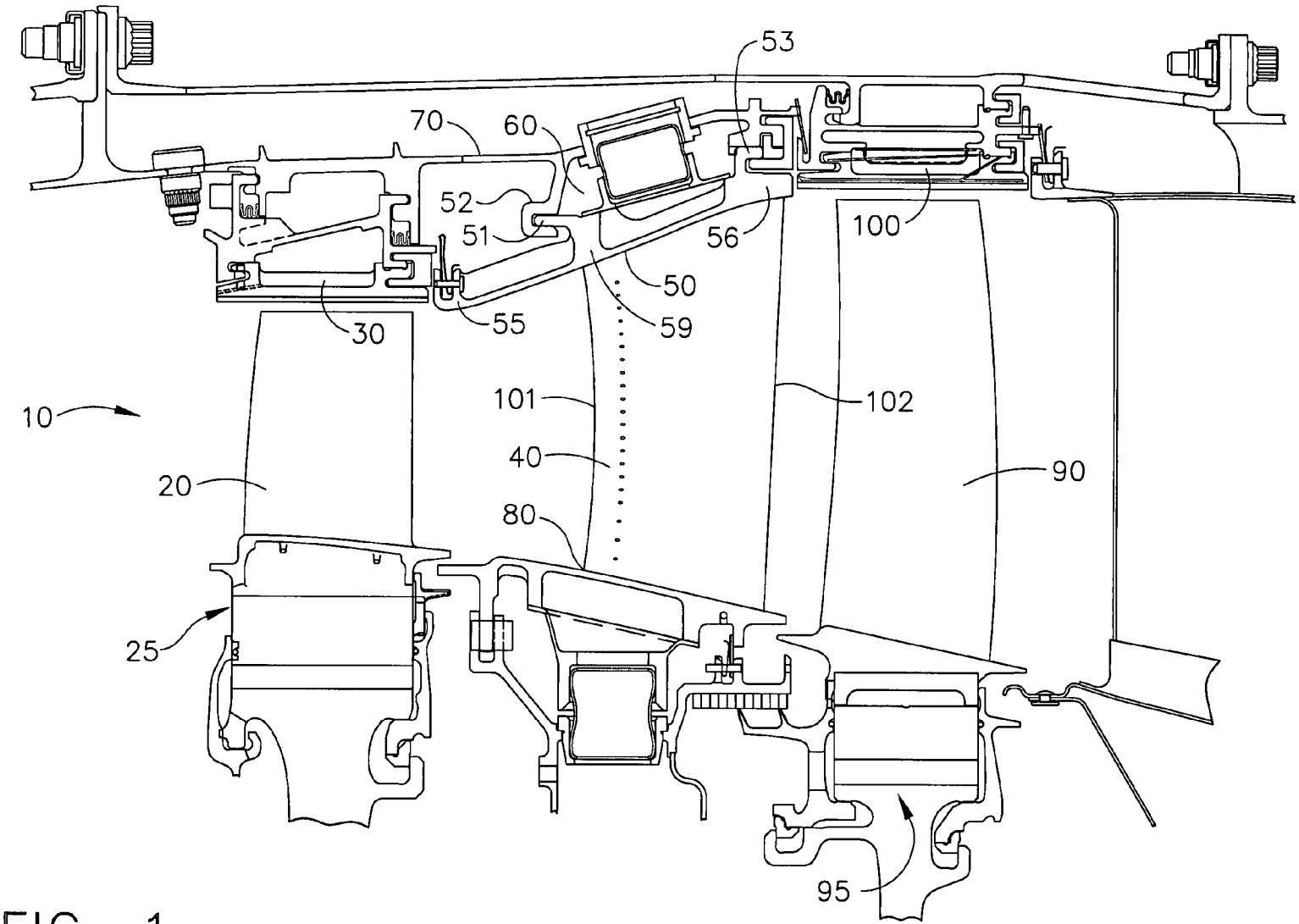
FIG. 1 is a longitudinal cross-sectional view illustration of the assembly of the turbine nozzle, shroud, shroud hangers and casing of a gas turbine engine.

Referring to the drawings wherein identical reference numerals denote the same elements throughout the various views, FIG. 1 a portion of turbine stage 10 comprising a Stage 1 turbine rotor 25, a Stage 2 turbine rotor 95 and a Stage 2 turbine nozzle 40 located in between. Turbine blades 20 and 90 are circumferentially arranged around the rim of the Stage 1 and Stage 2 turbine rotors respectively. Turbine shrouds 30, 100 are stator components arranged circumferentially in radial proximity to the tips of the turbine rotor blades 20, 90. The shrouds are supported on their outer side by shroud hangers that are in turn supported by flanges and connected to the casing 70.

Figure 2:
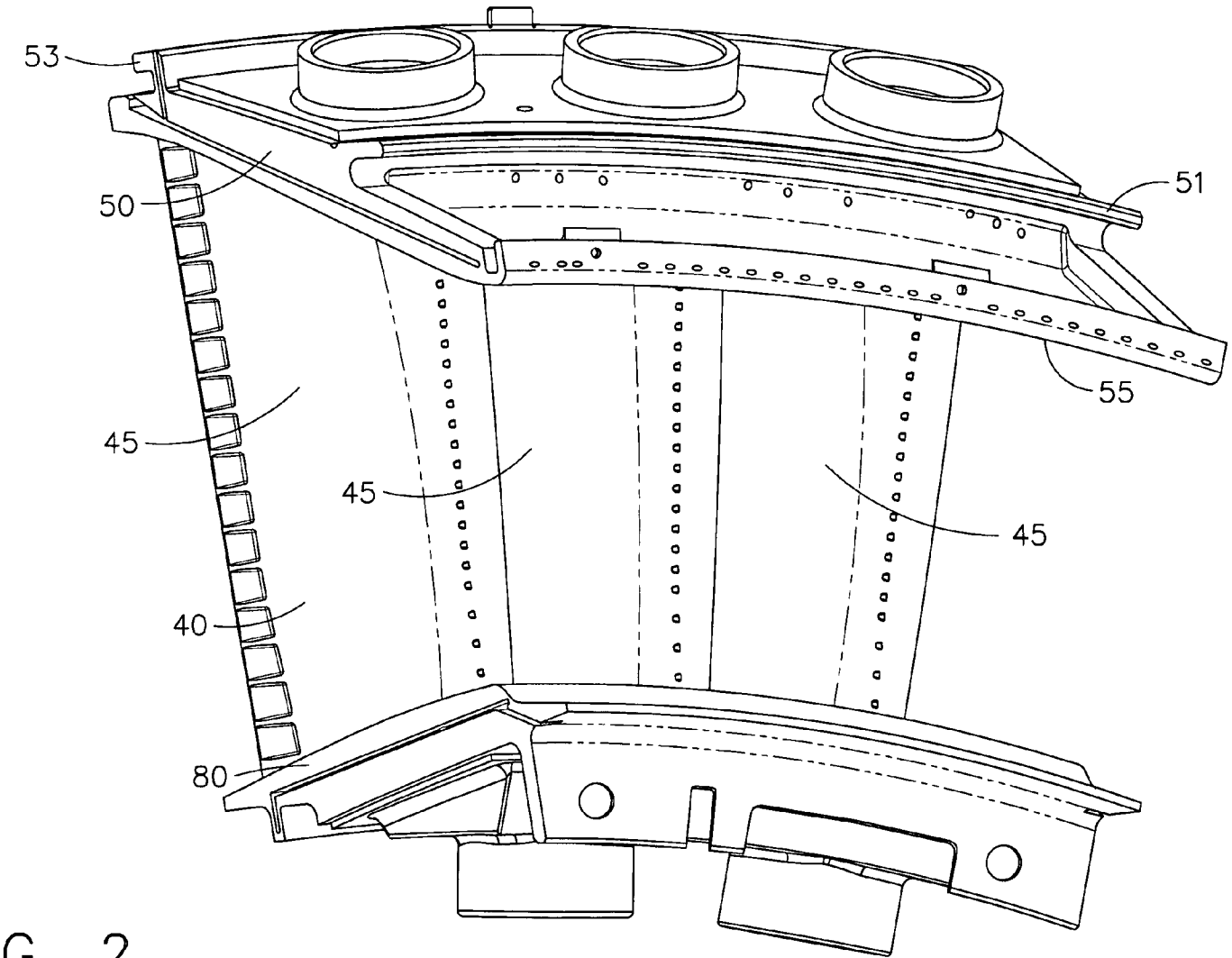
FIG. 2 is a perspective view illustration of a nozzle segment shown in FIG. 1.

As shown in FIG. 2 the turbine nozzle segment 40 comprises an inner band 80, and outer band 50 and vanes 45 that extend between the inner band and the outer band. The turbine nozzle segments 40 are usually have multi vane construction, with each nozzle segment comprising multiple vanes 45 attached to an inner band 80 and an outer band 50. The nozzle segment 40 shown in FIG. 2 has three vanes 45 in each segment. The turbine nozzle vanes 45 are sometimes hollow, as shown in FIG. 2, so that cooling air can be circulated through the hollow airfoil. The turbine nozzle segments, when assembled in the engine, form an annular turbine nozzle assembly, with the inner and outer bands 80, 50 forming the annular flow path surface through which the hot gases pass and are directed by the airfoils to the following turbine rotor stage.

Figure 4:
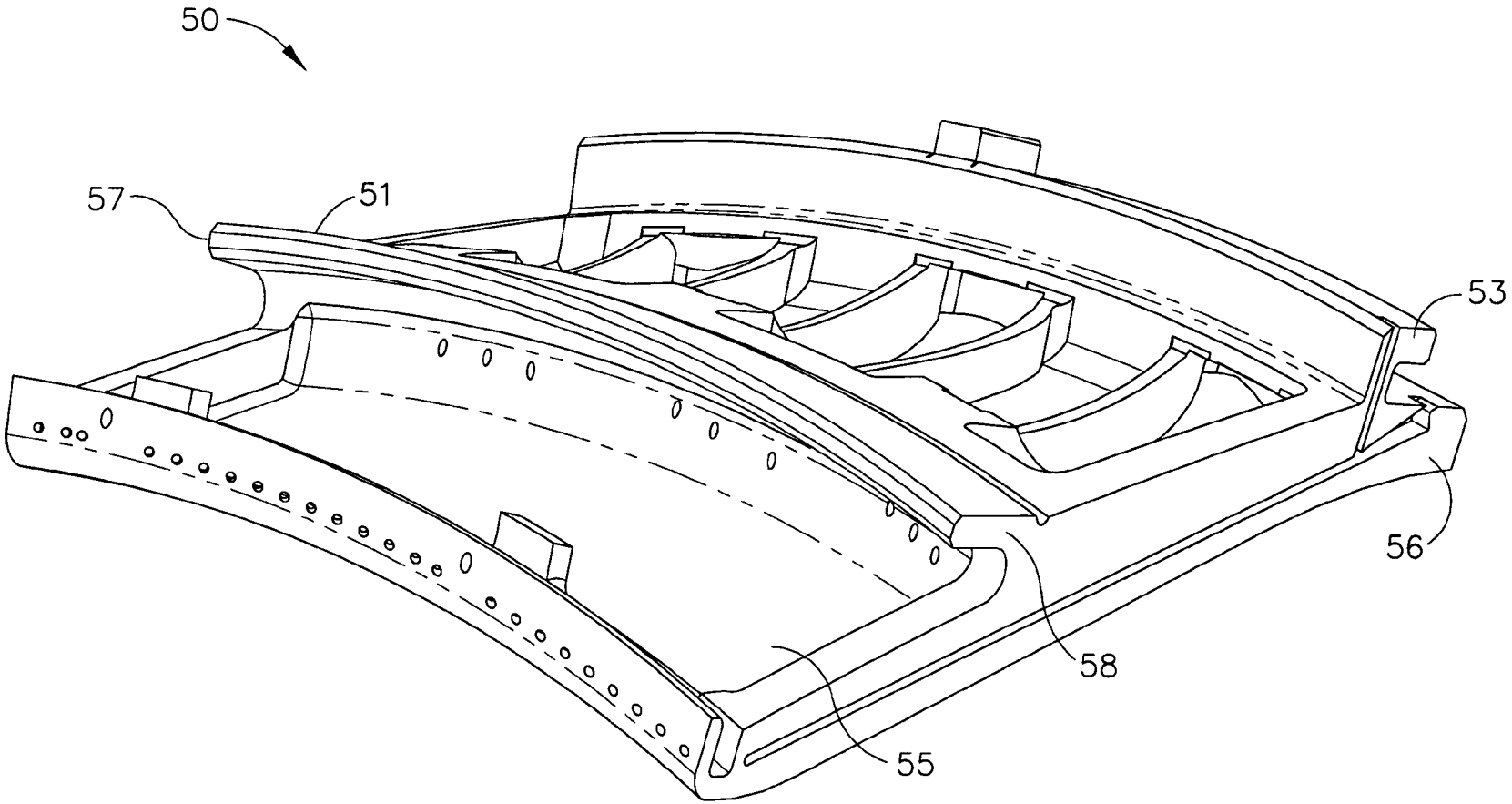
FIG. 4 is another perspective view illustration of the outer band of the nozzle segment shown in FIG. 2 viewed axially aft-wardly at an angle to another side.
Figure 5:
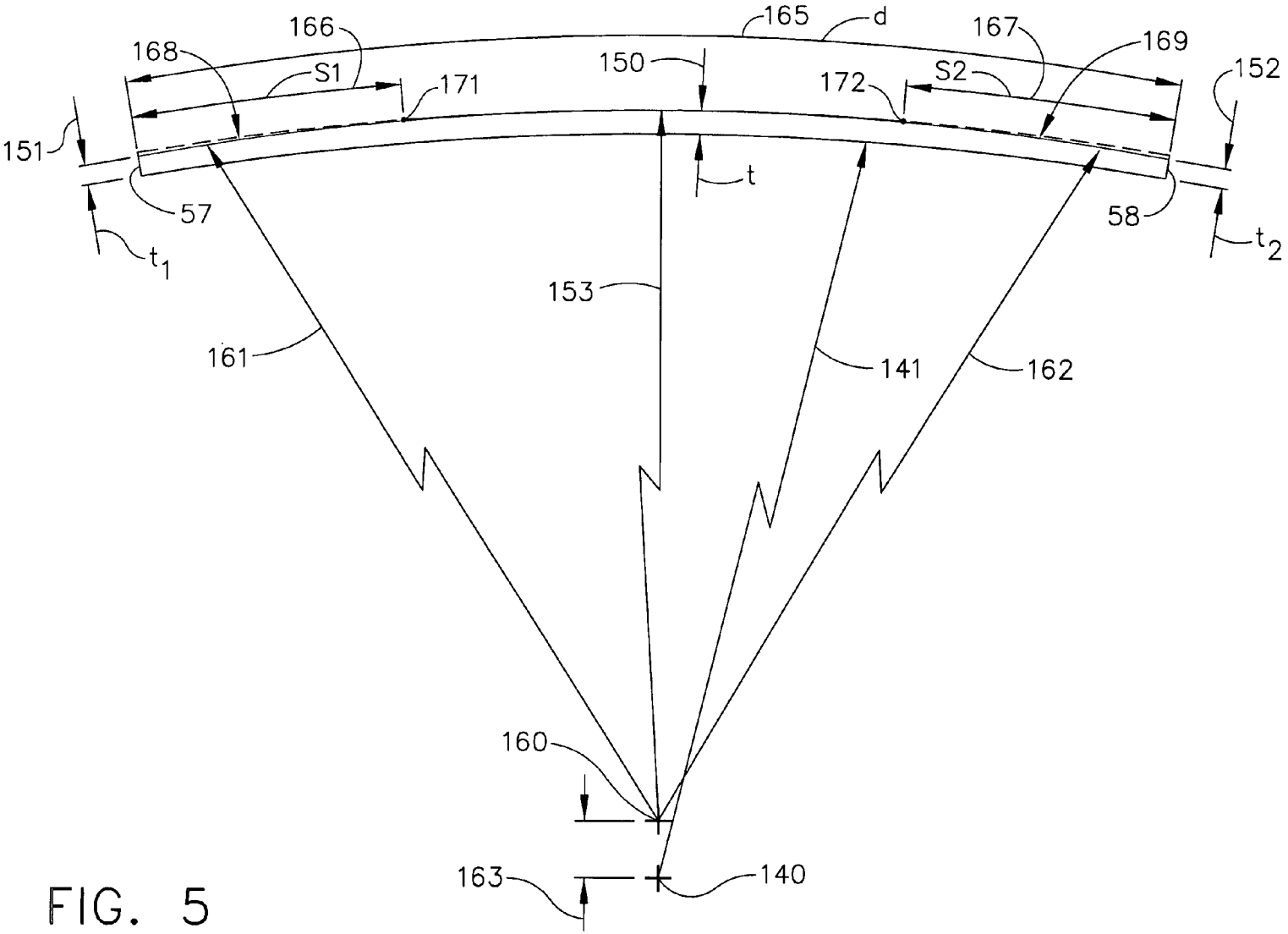
FIG. 5 is a schematic view illustration of an exemplary embodiment of a crowned flange tapered thickness feature.

The nozzle segment including the outer band may be made of a single piece of casting having the vane airfoils, the outer band and the inner band. Alternatively the nozzle segment may be made by joining, such as by brazing, individual sub-components such as vanes foils, the outer band and the inner band. FIG. 4 and FIG. 5 show such a sub-component, the outer band 50, which has airfoil cut-outs 65 wherein the vane airfoil 45 can be inserted and joined by a suitable means such as brazing.

Figure 3:
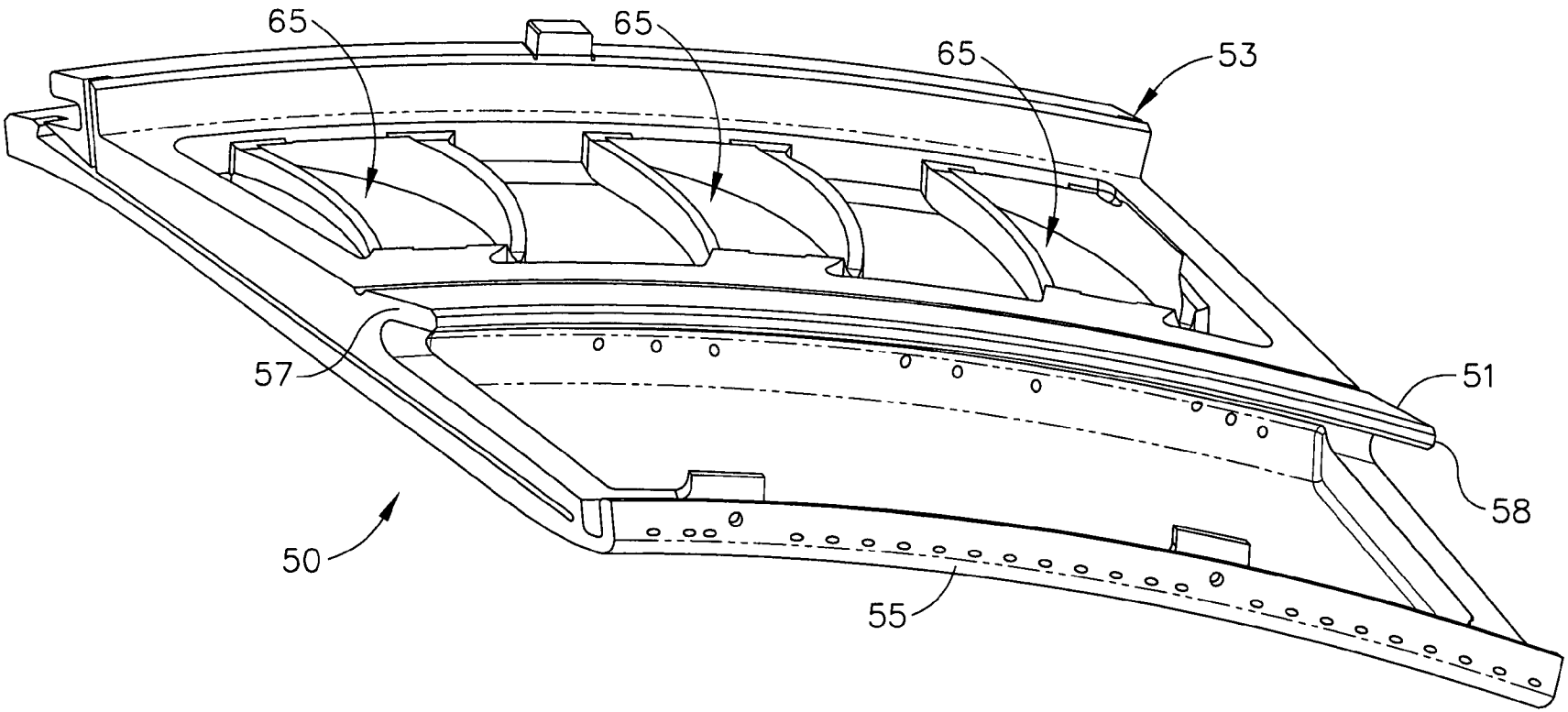
FIG. 3 is a perspective view illustration of the outer band of the nozzle segment shown in FIG. 2 viewed axially aft-wardly at an angle to one side.

The outer band 50 and inner band 80 of each nozzle segment 40 have an arcuate shape so as to form an annular flow path surface when multiple nozzle segments are assembled to form a complete turbine nozzle assembly. As shown in FIG. 1, the outer band 50 comprises an outer band forward panel 55, a forward flange 59 and an aft flange 56 located axially aft from the forward flange 59, that are used to provide radial support for the nozzle segment 40. The forward flange 59 comprises a forward arcuate rail 51 which extends from a first end 57 to a second end 58 located at a circumferential distance from the first end 51, shown in FIGS. 3 and 4. Similarly, the aft flange 56 comprises an aft arcuate rail 53 which extends from the first end 57 to the second end 58 located at a circumferential distance from the first end 51. At assembly, the forward arcuate rail 51 engages with a clearance fit with an arcuate groove in the forward nozzle support 52 extending from a casing 70. The aft arcuate rail 53 is attached to the casing by means of C-clips engaging with a casing aft flange.

Figure 9:
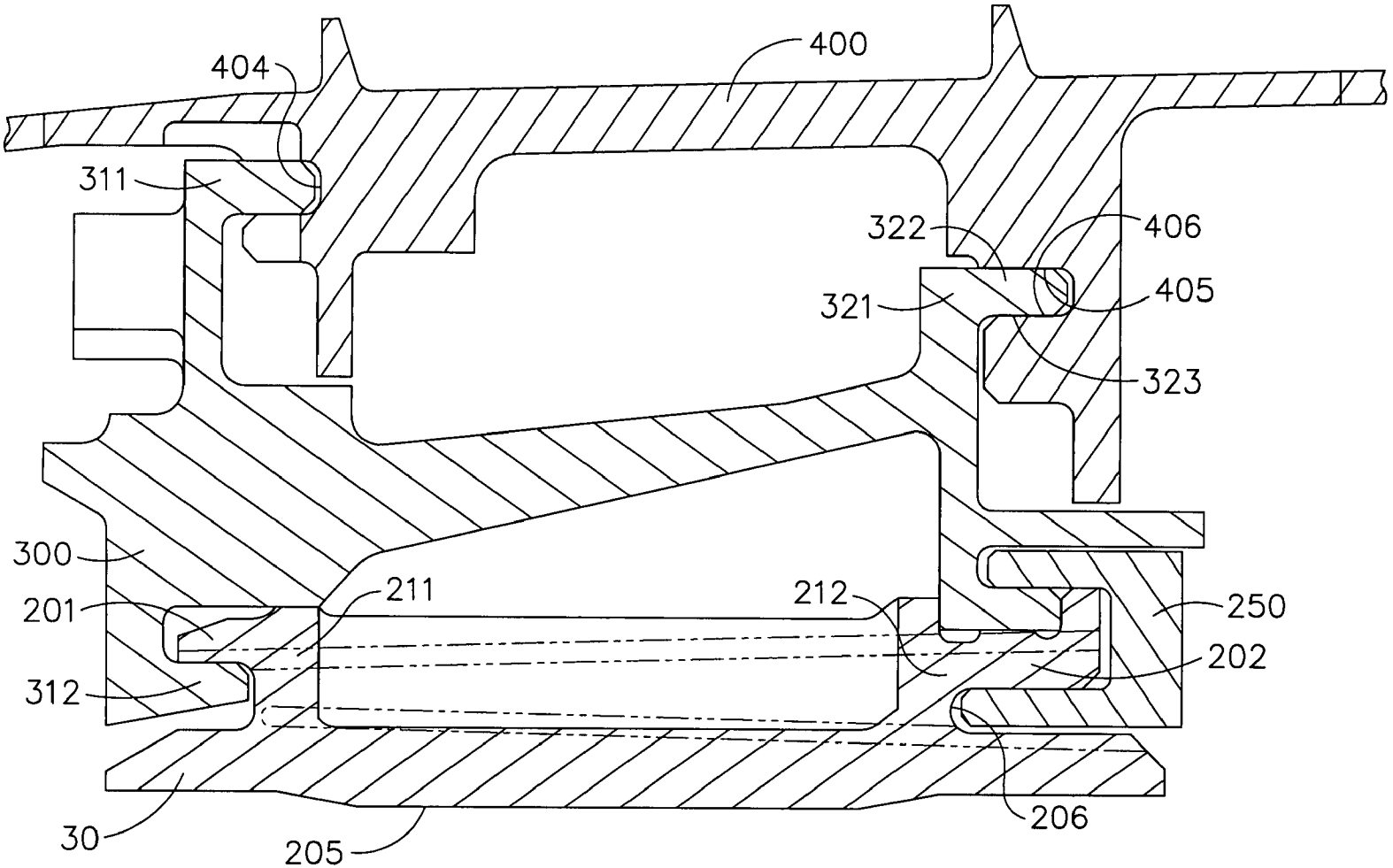
FIG. 9 shows an enlarged longitudinal cross-sectional view illustration of an assembly of a shroud, shroud hanger and the casing of a gas turbine engine.
Figure 10:
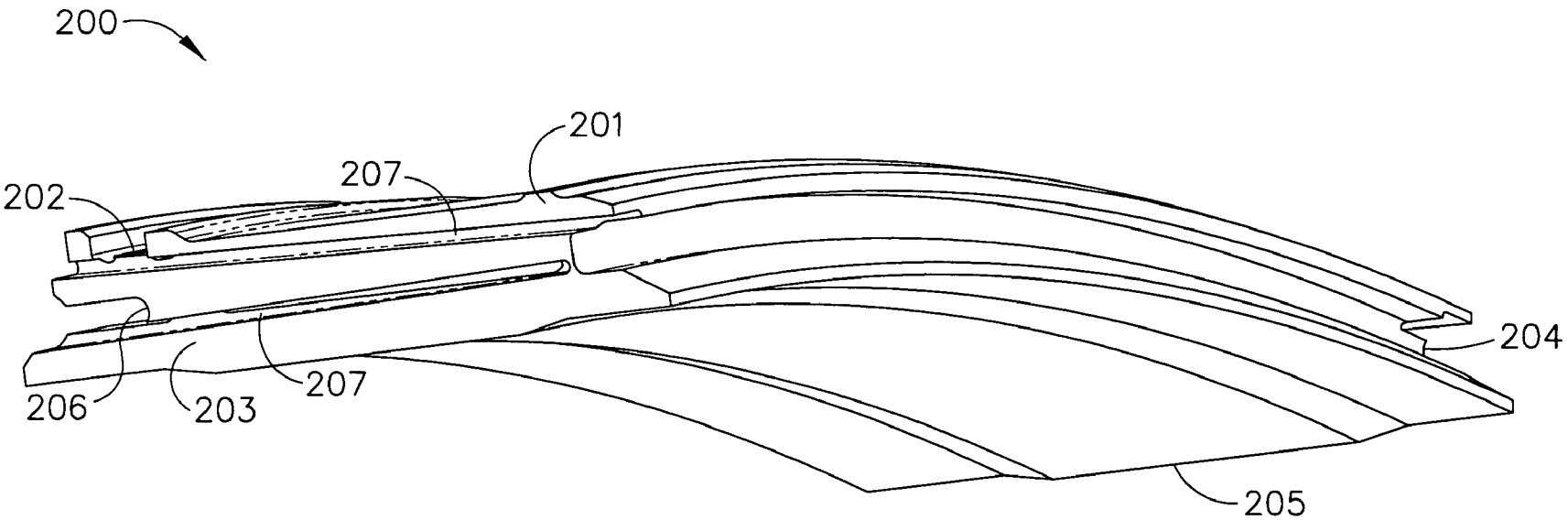
FIG. 10 is a perspective view illustration of a shroud segment shown in FIG. 1.

FIG. 9 shows an attachment of exemplary turbine shrouds such as the Stage 1 turbine shroud 30 to exemplary shroud hangers 300 using an arcuate forward flange 211 and an arcuate aft flange 212 located axially aft from the arcuate forward flange 211. The arcuate shroud forward flange 211 has an arcuate forward rail 201 that engages a corresponding arcuate groove in the shroud hanger 300. The arcuate shroud aft flange 212 has an arcuate aft rail 311 which is attached to the shroud hanger by mean of a C-Clip 250. An exemplary arcuate shroud segment 200 comprising an arcuate shroud forward rail 201 and an arcuate shroud aft rail 311 is shown in FIG. 10.

Figure 11:
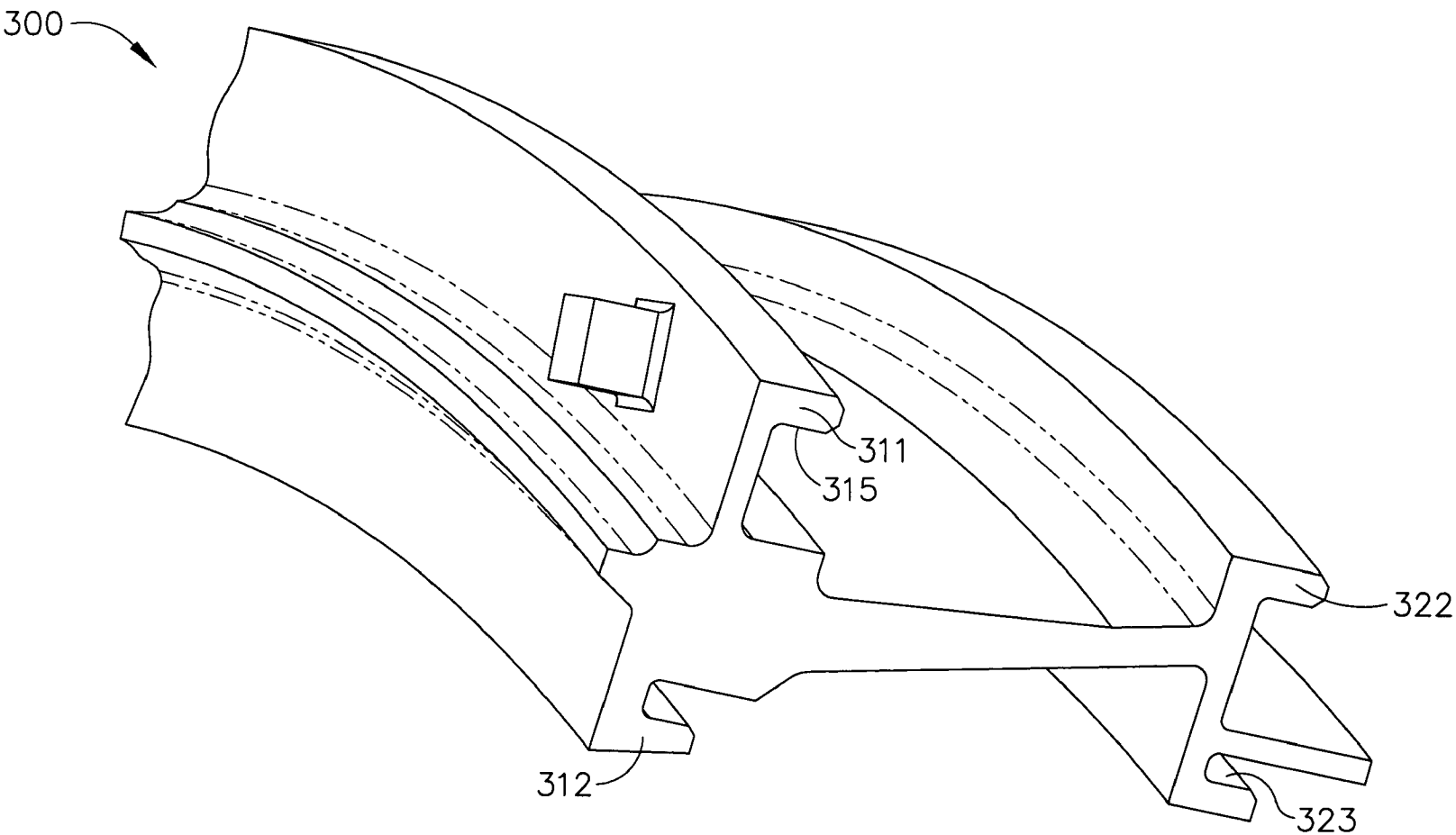
FIG. 11 is a perspective view illustration of a shroud hanger segment shown in FIG. 9.

FIG. 9 also shows an attachment of exemplary shroud hanger 300 to the turbine casing 400. The exemplary shroud hanger 300, shown in isometric view in FIG. 11, has an arcuate forward outer rail 311 and an arcuate aft outer rail 322 that are used to attach the hanger 300 to the turbine casing 400 by means of arcuate flanges and arcuate rails. The forward and aft arcuate rails 311, 322 may be continuous, as shown in FIG. 11, or segmented in the circumferential direction. In the exemplary embodiment shown in FIG. 9, the hanger aft arcuate rail 322 engages a corresponding casing arcuate aft groove 405 in an aft flange extending inwardly from the casing 400. The hanger forward outer arcuate rail 311 engages with a casing forward arcuate groove 404 in a forward flange extending inwardly from the casing 400.

An exemplary embodiment of the present invention to reduce the chording stresses in arcuate components supported by arcuate flanges is shown in FIG. 5. The arcuate component has an arcuate rail, such as for example the forward arcuate rail 51 shown FIGS. 3 and 4 which provides support within a corresponding arcuate groove in another component, such as the forward nozzle support shown in FIG. 1. As shown in FIG. 5, the arcuate rail has a constant inner radius 141 that is continuous between a first end 57 and a second end 58. Unlike conventional designs of arcuate support rails, the thickness of the arcuate rail in an exemplary embodiment of the present invention is varied between the first end 57 and the second end 58 so as to reduce the chording stresses in the arcuate components supported by the arcuate rail. In the exemplary embodiment shown in FIG. 5, the thickness of the arcuate rail is tapered in a first taper region 168 and a second taper region 169. Specifically, the arcuate rail thickness is tapered from a value "t" at a first taper location 171 to a value "t1" 151 at the first end 57, and tapered from a value "t" at a second taper location 172 to a value "t2" 152 at the second end 58. The variation of the thickness of the arcuate rail by means of tapering in selected regions allows the arcuate rail more flexibility to expand within the arcuate groove with which it engages during thermal variations, while maintaining the thickness in a middle region acts to prevent leakage of hot gases through the groove.

The taper in the first taper region 168 and the second taper region 169 can be introduced in a variety of ways. For example, they may be introduced by grinding a flat surface on the outer portion on the taper regions 168 and 169. Another exemplary way of introducing the taper is by using first taper radius 161, a second taper radius 162 and an outer radius 153 between the first taper location 171 and the second taper location 172, as shown in FIG. 5. Any required thickness can be achieved by selecting a suitable offset between the rail inner center 140 and the rail outer center 160.

In the preferred embodiment of the design for an outer band of a nozzle segment (FIGS. 3, 4), the first taper location 171 and the second taper location 172 are coincident at the midpoint on the outer surface of the arcuate rail. The first taper radius 161 and the second taper radius 162 are equal. For the outer band of the nozzle segment the forward arcuate rail 51 had an inner radius 141 of 12.596 inches, an outer radius 153 of 12.686 inches, a first taper radius 161 of 11.786 inches, a second taper radius 162 of 11.786 inches. The magnitude of the reduction in thickness of the arcuate rail varied from about 0.0000 inches at the middle to about 0.0135 inches at the first end 57 and second end 58.

In the preferred embodiment of the design for a turbine shroud forward arcuate rail 201 (FIG. 9), the first taper location 171 and the second taper location 172 are coincident at the mid-point on the outer surface of the arcuate rail. The first taper radius 161 and the second taper radius 162 are equal. For the outer band of the nozzle segment the forward arcuate rail 51 had an inner radius 141 of 12.201 inches, an outer radius 153 of 12.275 inches, a first taper radius 161 of 11.425 inches, a second taper radius 162 of 11.425 inches. The magnitude of the reduction in thickness of the arcuate rail varied from about 0.000 inches at the middle to about 0.005 inches at the first end 57 and second end 58.

In the preferred embodiment of the design for a turbine shroud hanger aft outer arcuate rail 322 (FIG. 9), the first taper location 171 and the second taper location 172 are coincident at the mid-point on the outer surface of the arcuate rail. The first taper radius 161 and the second taper radius 162 are equal. For the outer band of the nozzle segment the forward arcuate rail 51 had an inner radius 141 of 13.302 inches, an outer radius 153 of 13.397 inches, a first taper radius 161 of 12.454 inches, a second taper radius 162 of 12.454 inches. The magnitude of the reduction in thickness of the arcuate rail varied from about 0.000 inches at the middle to about 0.010 inches at the first end 57 and second end 58.

Figure 6:
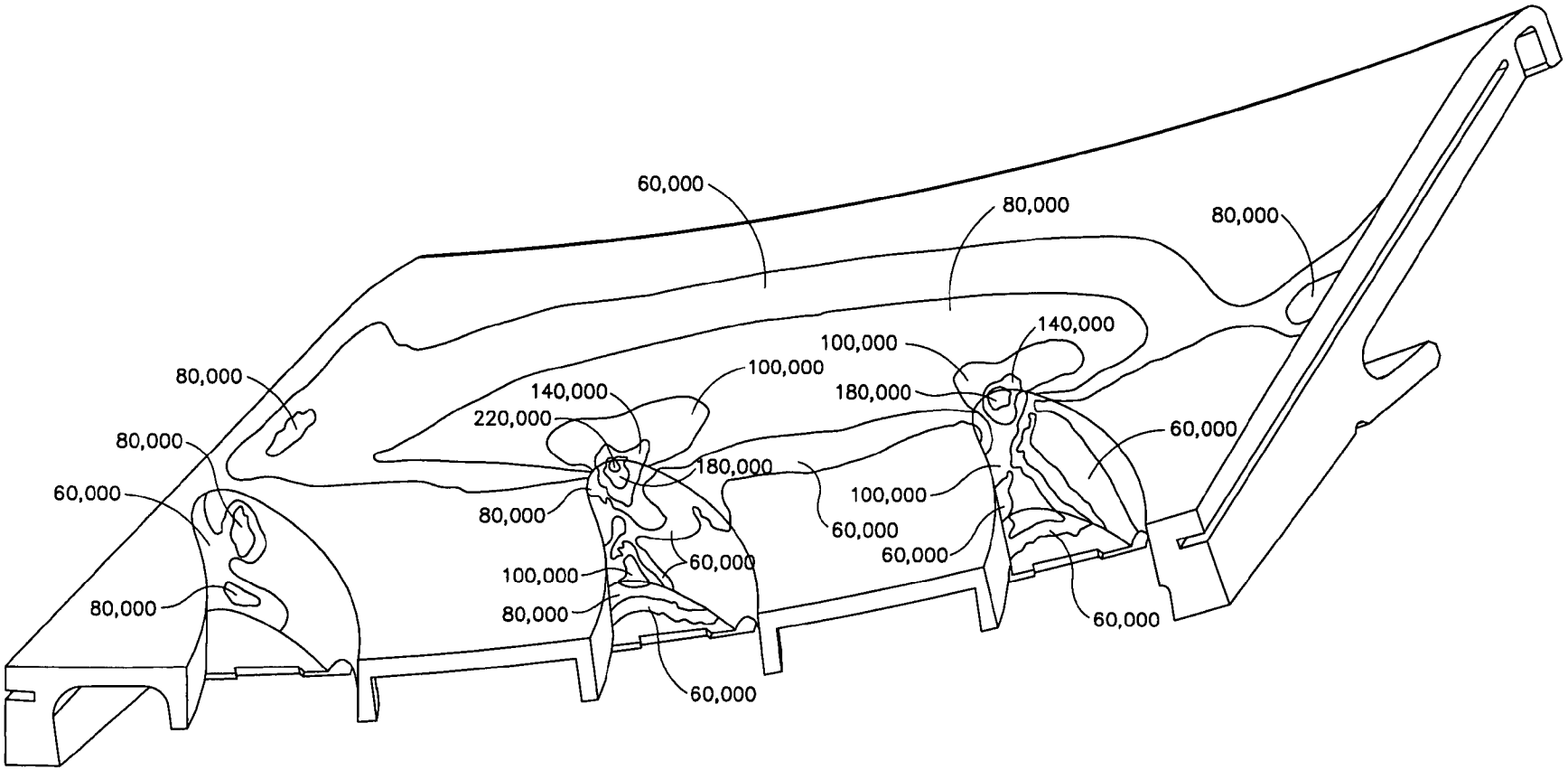
FIG. 6 is a perspective view illustration of a portion of a conventional design outer band of a conventional design nozzle segment showing stress contours that can occur in some designs.
Figure 7:
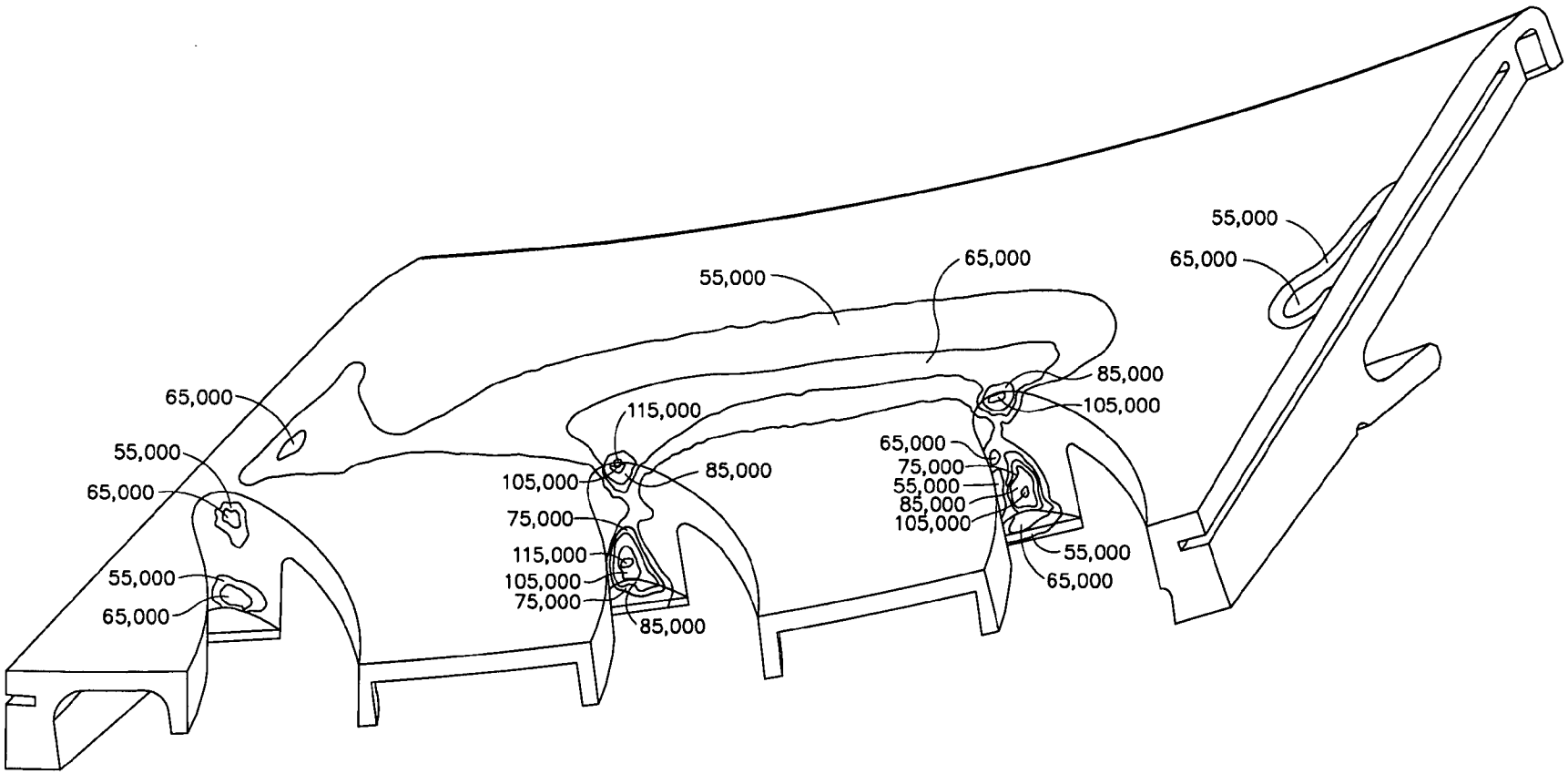
FIG. 7 is a perspective view illustration of a portion of an outer band of an exemplary embodiment of the present invention showing reduced stress contours.
Figure 8:
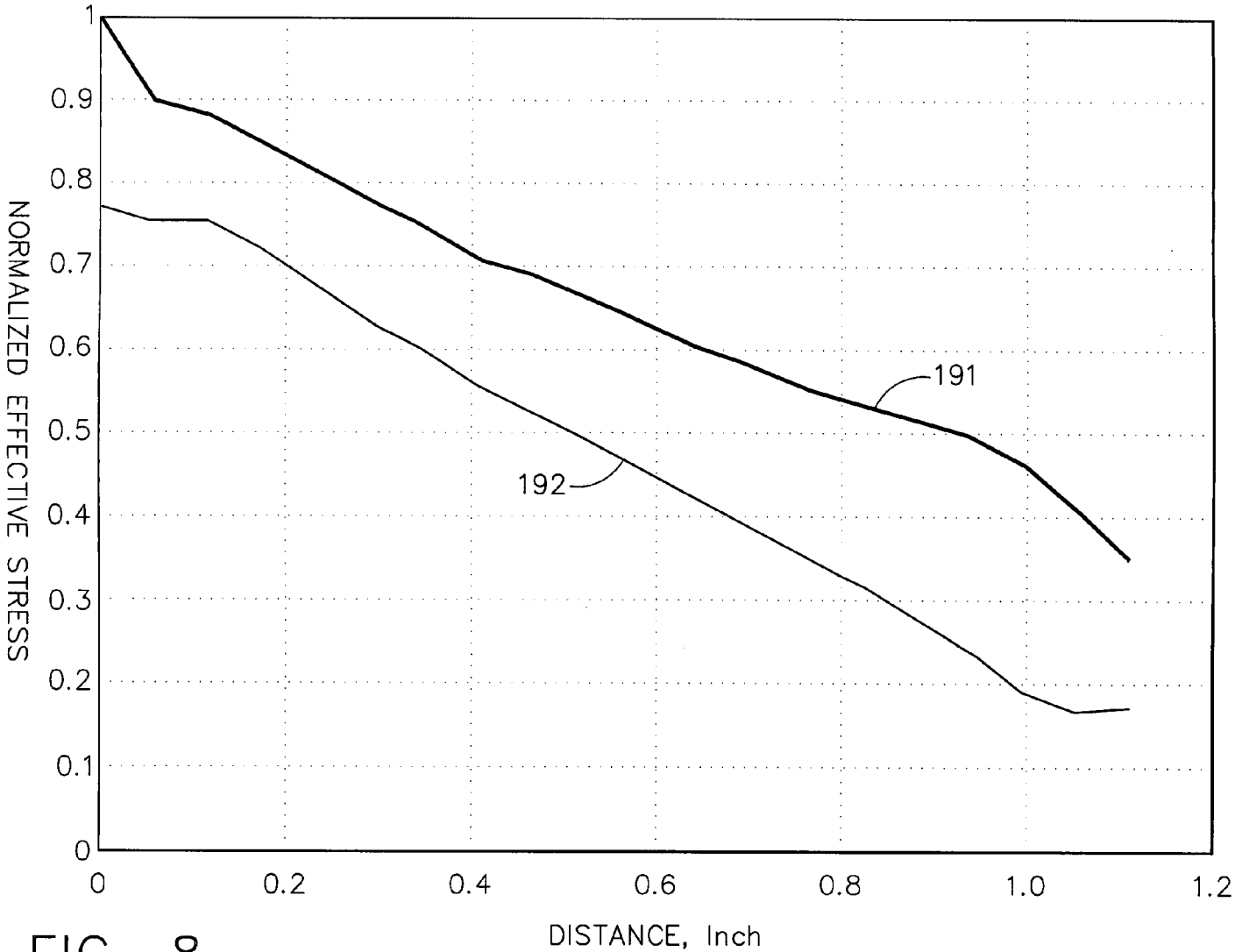
FIG. 8 shows the relative stress gradients near maximum stress locations in a conventional design outer band and an outer band with an exemplary embodiment of the present invention.

An example of the reduction in the stresses in an outer band of a turbine nozzle segment as a result of the increased ability of the arcuate rails to flex in the presence of thermal gradients by the preferred embodiment described herein is shown in FIG. 7. The peak stresses in the outer band near the leading edge of the mid vane is reduced as compared to the results for a conventional design outer band shown in FIG. 6. The reduction of the stresses in the outer band resulting from the implementation of the preferred embodiment of the present invention extend to other regions on the outer band also, as shown in the stress gradient plot shown in FIG. 8. The relative stress distribution 192 for the preferred embodiment in an outer band is significantly lower than the relative stress distribution 191 for a conventional design outer band.

While the invention has been described in terms of various specific embodiments, those skilled in the art will recognize that the invention can be practiced with modification within the spirit and scope of the claims.

What is claimed is:

1. A turbine shroud comprising:

a rail having an inner radius, a first end, a second end located at a circumferential distance from the first end, said inner radius being constant and continuous between said first end and said second end, a first taper location located at a first taper distance from the first end, a first taper region located between the first end and the first taper location, a second taper location located at a second taper distance from the second end, a second taper region located between the second end and the second taper location, and an outer radius between said first taper location and said second taper location such that a thickness t is defined between said inner radius and said outer radius, wherein the thickness of at least a portion of the first taper region is tapered between the first taper location and the first end and wherein the thickness of at least a portion of the second taper region is tapered between the second taper location and the second end.

2. A turbine shroud according to claim 1 wherein the thickness of the rail between the first taper location and the second taper location is substantially constant.

3. A turbine shroud according to claim 1 wherein the first taper distance and the second taper distance are substantially equal.

4. A turbine shroud according to claim 3 wherein the first taper distance and the second taper distance are substantially equal to half of the circumferential distance.

5. A turbine shroud according to claim 1 wherein the rail is an arcuate forward rail.

6. A turbine shroud according to claim 1 wherein the rail is an arcuate aft rail.

7. A turbine shroud according to claim 1 wherein the thickness of at least a portion of the first taper region is tapered by grinding an outer portion of the first taper region.

8. A turbine shroud according to claim 1 wherein the thickness of at least a portion of the second taper region is tapered by grinding an outer portion of the second taper region.

9. A turbine shroud according to claim 1 wherein the thickness of at least a portion of a taper region is tapered by using a first taper radius, a second taper radius and an outer radius between the first taper location and the second taper location.

10. A hanger for supporting arcuate components comprising:

a hanger rail capable of supporting an arcuate component, the hanger rail having an inner radius, a first end, a second end located at a circumferential distance from the first end, said inner radius being constant and continuous between said first end and said second end, a first taper location located at a first taper distance from the first end, a first taper region located between the first end and the first taper location, a second taper location located at a second taper distance from the second end, a second taper region located between the second end and the second taper location, and an outer radius between said first taper location and said second taper location such that a thickness t is defined between said inner radius and said outer radius, wherein the thickness of at least a portion of the first taper region is tapered between the first taper location and the first end and wherein the thickness of at least a portion of the second taper region is tapered between the second taper location and the second end.

11. A hanger according to claim 10 wherein the thickness of the hanger rail between the first taper location and the second taper location is substantially constant.

12. A hanger according to claim 10 wherein the first taper distance and the second taper distance are substantially equal.

13. A hanger according to claim 12 wherein the first taper distance and the second taper distance are substantially equal to half of the circumferential distance.

14. A hanger according to claim 10 wherein the rail is an arcuate rail.

15. A hanger according to claim 10 wherein the thickness of at least a portion of the first taper region is tapered by grinding an outer portion of the first taper region.

16. A hanger according to claim 10 wherein the thickness of at least a portion of the second taper region is tapered by grinding an outer portion of the second taper region.

* * * * *